United States Patent [19]

Strouse

[11] 4,333,616

[45] Jun. 8, 1982

[54] COLLAPSIBLE CORE PLATE CONSTRUCTION

[76] Inventor: Joseph Strouse, c/o Strouse Industries, Inc., 8090 Danbury Dr., Mentor, Ohio 44060

[21] Appl. No.: 188,864

[22] Filed: Sep. 19, 1980

[51] Int. Cl.[3] ..... B65H 75/18

[52] U.S. Cl. ..... 242/72 R

[58] Field of Search ..... 242/72, 81, 78.6, 110, 242/110.1, 71.8, 71.9, 64

[56] References Cited

U.S. PATENT DOCUMENTS 1,664,738 4/1928 Deline ..... 242/72 X 1,979,423 11/1934 Tondreau ..... 242/72

3,779,476 12/1973 Hofbauer ..... 242/72

3,878,999 4/1975 Daves ..... 242/72 R

*Primary Examiner*—Edward J. McCarthy

*Attorney, Agent, or Firm*—Frank B. Robb

[57] ABSTRACT

Recoiler mechanism including a core plate having a main body and complementary peripheral portions integral with the body and forming with the body, a surface about which material may be coiled, the portions terminating in adjacent free ends, and provisions intermediate the free ends to effect initial expansion and subsequent collapsing of at least part of the portions to enable removal of the material coiled about the surface.

8 Claims, 10 Drawing Figures

COLLAPSIBLE CORE PLATE CONSTRUCTION

BACKGROUND AND OUTLINE OF THE INVENTION

Core plate and collapsible drum and slip core recoiling in conjunction with a slitting operation are well known and in certain circumstances may involve plain non-collapsible core plates, multiple segment collapsible drum and non-collapsible slip core drum which usually involve the provision of paper cores which become a part of the coil where strands of slit stock are to be recoiled. It should be understood that language used in the art in which the invention hereof is found, may include the terms "collapsible" and "expandible" and it is contemplated that for the purposes hereof, they may be used interchangeably as involving constructions which are equally effective in producing identical results in the ultimate use of mechanisms which may be thus described.

It is therefore the principal purpose of the invention to provide collapsible core plate construction which is relatively inexpensive to manufacture yet satisfactory for widespread application.

Further the actual construction of the core plates hereof provides for manipulation of the same to collapse the plate and subsequently to set them for recoiling and again release subsequently upon completion of coiling thereon being simple and rapid with further resetting being likewise readily effected.

The core plates which are constructed in accordance with the disclosure herein, involve a composite arrangement, with what may be termed a sort of laminated assembly from parts essentially comprising discs of 11 and 16 gauge material which have been initially machined to make portions expandible and contractible and facilitate incorporation of certain cam elements therein to provide such movement.

Further, suitable brake or clutch elements are bonded to certain of the parts initially for subsequent clutching driving action to be effected thereby, when the assembly is mounted in recoiling position.

Other and further aspects of construction and improvement provided hereby are disclosed in detail in the specification and shown in the drawings appended hereto, wherein.

DETAILED DESCRIPTION OF THE INVENTION

Figure 1:
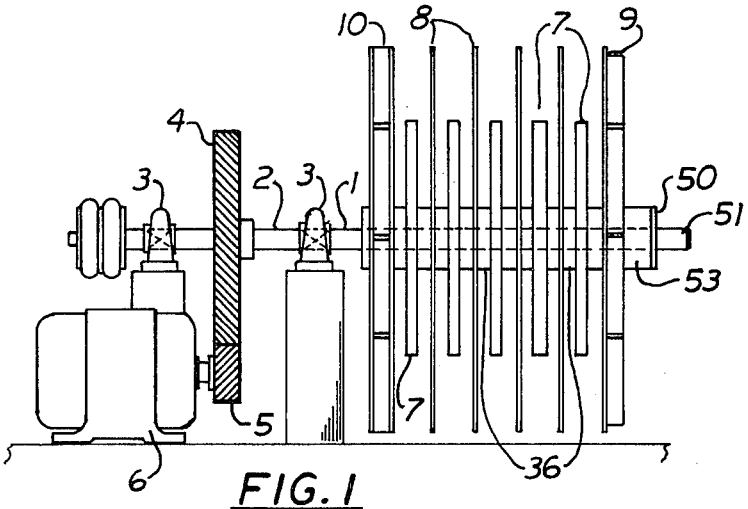
FIG. 1 is a somewhat diagrammatic view in elevation, showing the essential elements of a recoiler such as that with which the core plates hereof are used.

Referring to FIG. 1, a recoiling construction is shown such as might be used in conjunction with slitter operation, in this instance being a simple disclosure involving a recoiler shaft generally designated 1 connected to a drive shaft 2 in alignment therewith, the drive shaft in turn being supported by suitable pillow blocks such as 3, and the drive shaft 2 being driven by a large gear 4 from a smaller gear 5 connected to an electric motor 6 suitably operable by switching and controls not here illustrated in detail.

The recoiler elements which are in this instance generally specified as being core plates, and in turn designated 7, are suitably mounted on the recoiler shaft 1, each core plate being provided for a slit coil of metal or the like, and separated by suitable separators 8, with end plates 9 and 10, for purposes which will readily appear and in this instance as is obvious the recoiling of 5 coils or slitted portions of an initial coil of stock is intended to be provided for.

Figure 2:
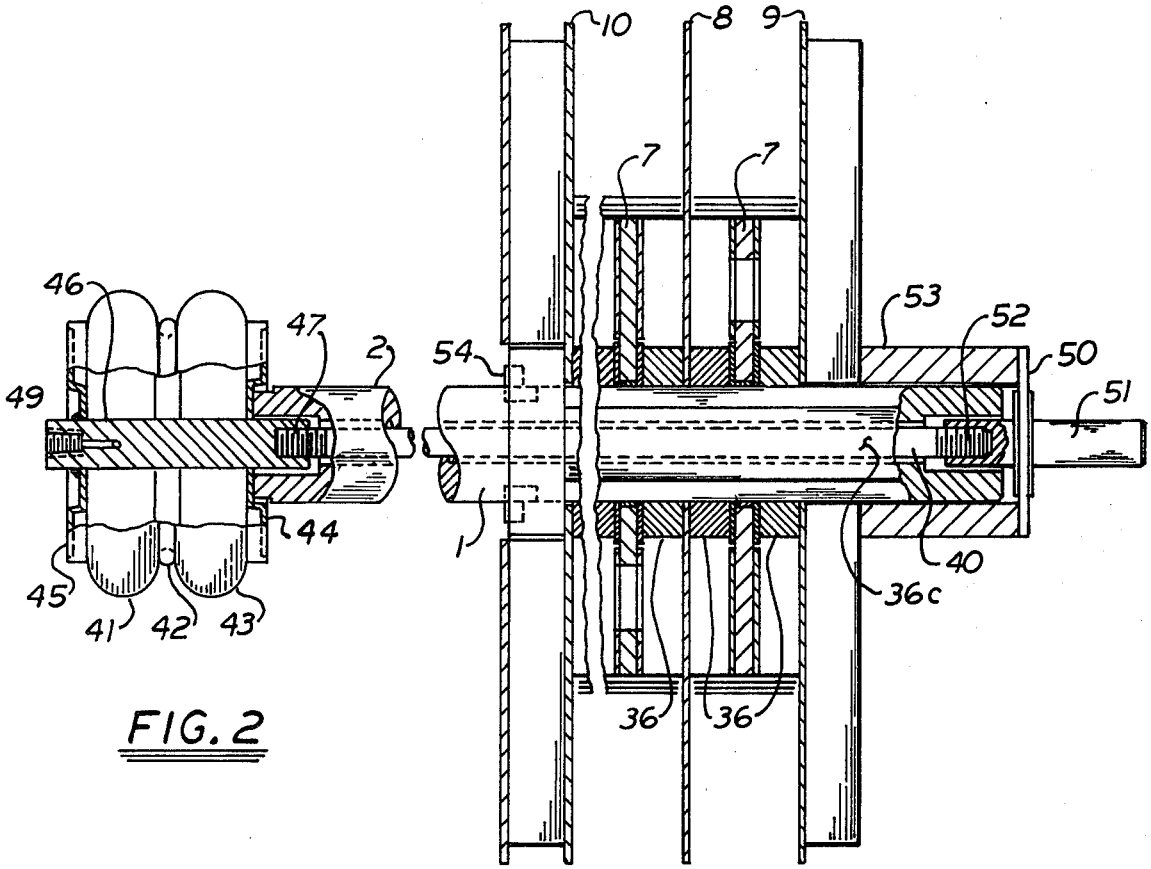
FIG. 2 is a more detailed view, somewhat fragmentary, with parts in section, further illustrating the construction of the core plates hereof and the environment in which they are used.

Turning to the detailed construction of the slitting recoiling aspects, FIG. 2 is referred to, and fragmentary as it is shows a portion of the disclosure of FIG. 1 indicating in detail the core plates 7 and the end plates 9 and 10 with an intermediate plate separator 8, all mounted for rotation on the recoiler shaft designated 1.

Figure 3:
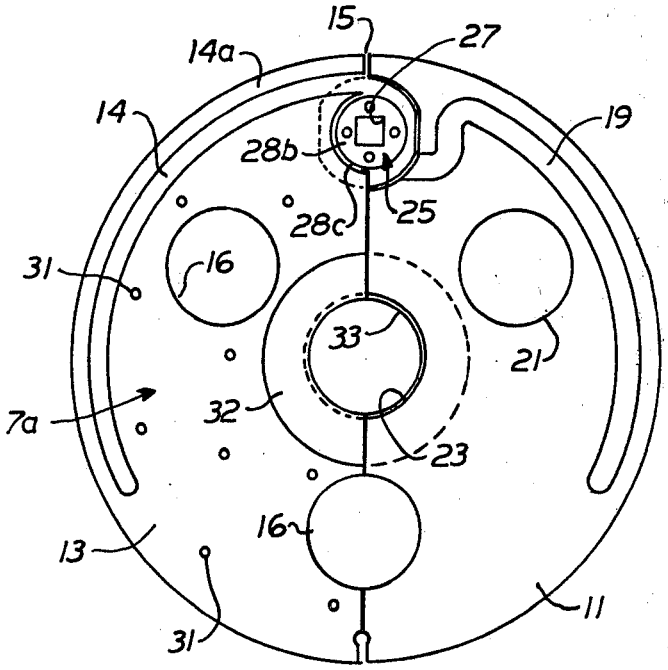
FIG. 3 is a composite view disclosing formations of certain of the core plate elements.
Figure 4:
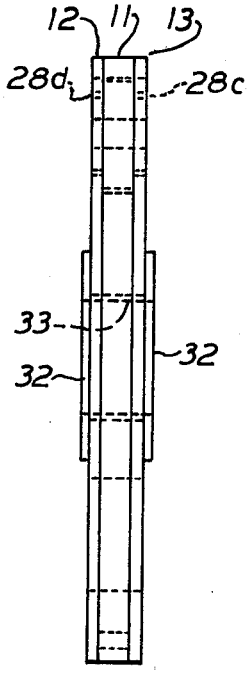
FIG. 4 is an edge view of the core plate assembly hereof.

Turning now to a consideration of other views in the drawings, the core plate construction which is the essential aspect of this invention, is shown in the figures specifically FIGS. 3 and 4 as comprising central plate member 11, with a side plate member 12 at one side and a substantially identical member 13 at the opposite side of said central plate member 11.

These members are discs, and the plate 11 is intended to be formed of 11 gauge material, although not limited necessarily to that thickness. The plates 12 and 13 are in this instance formed of 16 gauge material so that the composite construction provided as illustrated in FIG. 4, is approximately ¼ of an inch in thickness, and about 16 inches in diameter as an example.

Turning to a consideration of FIG. 3, which is a composite view showing the formation in plan of the side plates 12 and 13 in this instance the plate 13 being the subject of consideration, it is noted that it is provided near the outer periphery with an arcuate slot 14 therein extending to a radial slot 15.

Slot 14 is fairly narrow in width, and provides a sort of flexible tongue 14*a*.

It will be noted that a slot like 14 is similarily provided on the other side of the slot 15 in the plate 13, and the tongue is thereby suitably flexible at that opposite side providing substantial peripheral flexibility.

The holes indicated at 16 are simply for stress relief purposes and to lighten the construction.

Figure 5:
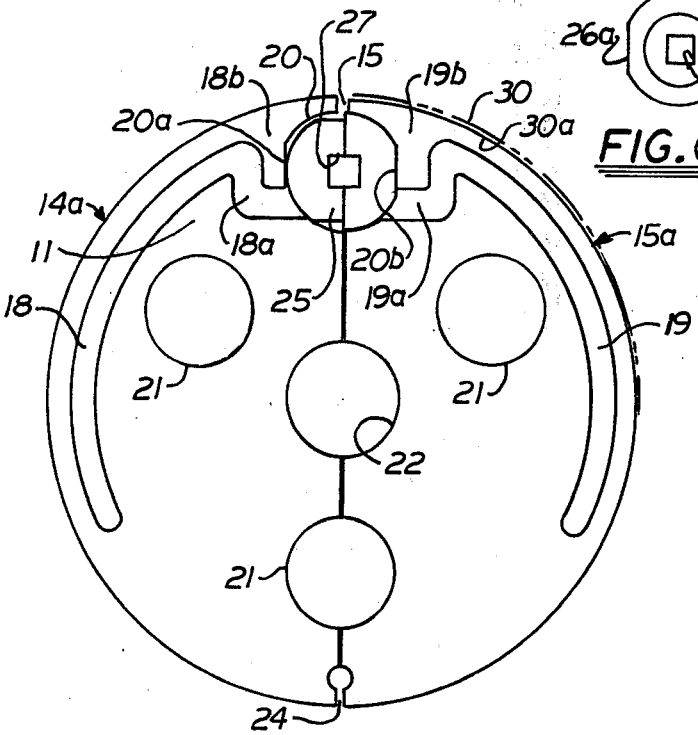
FIG. 5 is a view somewhat similar to FIG. 3, showing more detail of one of the core plate elements.

The central plate 11, shown in FIG. 5, is a similar disc, in this instance a slot 18 being provided at one side of the center line and of the slot 15, a slot 19 being formed similarly on the other side of slot 15, these arcuate slots in the discs 11, 12 and 13 being therefore substantially co-extensive.

As will be apparent these slots 18 and 19 extend for a substantial distance around and near the periphery of the discs.

At the adjacent ends of the slots 18 and 19 slot formations 18*a* and 19*a* respectively are provided, so that a substantial area of stock is left at 18*b* and 19*b* for purposes which will be understood as this description proceeds.

The area at the adjacent ends 18*a* and 19*a* of the disc 11, is provided with an opening 20, which is machined so that it is formed with a flat area 20*a*, the opposite side of that opening 20 being similarly formed with a flat area 20*b*.

The plate member 11 is equipped with suitable openings 21 therein, a central opening 22 being provided, which finds its counterpart in a central opening aligned therewith in the discs 12 and 13 and designated 23.

A slit 24 is formed at the opposite end of the diameter at which the slot 15 is formed, and is provided in the plate members 12 and 13 as shown in FIG. 3 so that the same can be used in a manner to be explained.

Figure 6:
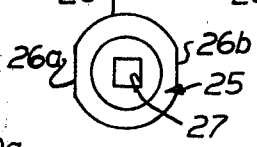
FIGS. 6 and 7 are plan and edge views respectively, of a cam member used in the core plate assembly.
Figure 7:
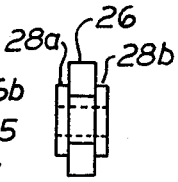

The manufacture of the member 11, being the central plate as will be recalled, enables the opening 20 to receive therewithin a cam unit generally designated 25, which as shown in FIGS. 6 and 7 is generally circular, having a cam part 26 which is provided with flats 26*a* and 26*b*.

This cam member 26 is formed of 11 gauge stock basically, and provided at its center with a square opening 27.

At opposite sides of the part 26, are circular washer like parts 28*a* and 28*b*, these being of 16 gauge thickness and suitably fastened to the member 26, and welded together form a single part.

These parts 28*a* and 28*b* will likewise be provided with square openings therein aligned with the square opening 27 previously mentioned.

There is thus formed the cam member 25, which is shown in FIG. 5 in place, but rotated 90 degrees so that the peripheral edge of the plate member 11, will have assumed the dotted line position designated at 30.

This position provides the basis for machining the entire unit, so that the periphery ultimately developed is circular only in its expanded condition so to speak, that is when the cam member 25 is in the position shown in FIG. 5.

It will thus be apparent that in order to make such a form possible, the cam member 25 will have been placed in position initially with the flat areas thereon designated 26*a* and 26*b* respectively, in alignment with the flats 20*a* and 20*b* of the member 11.

Thereafter the side plates 12 and 13 will be placed in position, so as to support the cam member for rotation upon the parts 28*a* and 28*b* respectively, and the plates spot welded as at 31 to opposite sides of plate member 11.

The circular parts 28*a* and 28*b* are supported for rotation in aligned circular openings in plates 12 and 13, one such being designated 28*c* in FIG. 3, as shown, the aligned opening in plate 12 being designated 28*d* as seen in FIG. 4.

The plates 11, 12 and 13 are suitably fastened together in alignment thereafter, as by spot welding the same as suggested at 31 in FIG. 3.

When thus integrally connected together the composite of parts becomes an integral unit and could be made from a single piece of material if desired.

There is thus formed a main body 7*a* having complementary arcuate tongues 14*a* and 15*a* integral therewith and terminating adjacent one another at their free ends, together providing a surface, of which portions are expandible for winding material thereabout and subsequently collapsible to then remove the resulting coil of material.

The resiliency provided by the tongues 14*a* and 15*a* formed by the arcuate slots 18 and 19 and those in plates 12 and 13 aligned therewith, is relied on to effect collapsing action to the solid line position 30*a* in FIG. 5, by manipulation of cam member 25, to bring the flat 26*b* into contact with corresponding flat 20*b*.

Comparable action of tongue 14*a* will also have taken place at the same time.

It is noted that machining of the assembly to provide a circular periphery will have been previously resorted to when the tongues 14*a* and 15*a* are in their expanded condition so to speak, to produce a circular condition suggested by the said dotted line 30.

Thus the full line position 30*a* is well within that circular area and produces what is called the collapsed condition of the core plate 7.

Turning momentarily to a consideration of other aspects of this assembly, it should be noted that clutch lining material indicated at 32, in the figures, is bonded to each side of the assembly, specifically to the outer faces of the plates 12 and 13. The clutch facing material is a frictional type material and of sufficient extent to provide for clutching action to take place.

Centrally of the assembly is a bearing 33, to support the assembly on the recoiler shaft 1.

Figure 10:
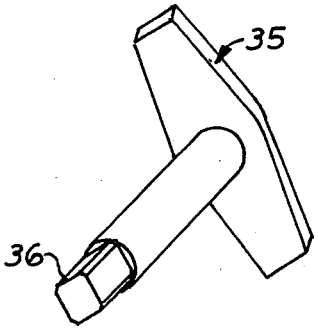
FIG. 10 is a perspective view of a wrench used to set and release the core plates.

It may be noted at this stage that the wrench designated 35 shown in FIG. 10 will have been appropriately manipulated by insertion of the square end 36 thereon in the opening 27 of the cam member 25, the rotative manipulation previously mentioned and for purposes subsequently to be described being effected.

Figure 8:
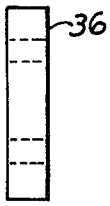
FIGS. 8 and 9 are edge and plan views respectively of clutch discs used.
Figure 9:
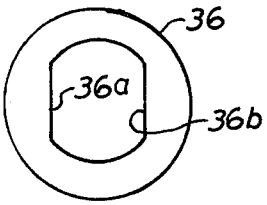

Keeping specific details of the core plate assembly in mind as it is in its composite arrangement, it will be understood that the same may be thereafter supported on the recoiler shaft 1, and for that purpose suitable spacers in the form of clutch discs 36 shown in FIGS. 8 and 9 will be availed of, such discs 36 being of any suitable thickness, so that when emplaced one at each side of the core plate assembly 17, will provide the necessary spacing for the slit stock to be received between the plates 8 and 10 for example.

It will be understood that the clutch discs 36 are equipped with flats 36*a* and 36*b* respectively, which are in turn mated with corresponding flats such as 36*c* on the recoiler shaft 1, and oppositely disposed.

As noted and as shown in FIG. 1 a series of the core plates 7 can be availed of and positioned with suitable clutch discs supported on the recoiler shaft 1 to thereby provide the spacing necessary for the stock to be received on the peripheries of the plates 7 between the various separator plates 8, 9, and 10.

In order to provide for clutching engagement of the core plates 7 to the shaft 1, suitable actuating mechanism is required and in this instance involves a rod 40 extending through the center of the recoiler shaft 1, and likewise the drive shaft 2, to the opposite end thereof, where there is positioned a suitable actuator designated 41 in this instance being an air actuator and including the bellows units 42 and 43 with a plate 44 at one side and a plate 45 opposite thereto and between which the bellows 42 and 43 are mounted.

The plate 45 on the actuator 41 is connected to the pull rod by a suitable means providing a shaft 46 and threadedly engaged at 47 to the pull rod 40, and at its opposite end provided with a suitable inlet 49 for air to be admitted into the bellows 42 and 43.

At the opposite end of the mechanism just described, and specifically at the end of the recoiler shaft 1, is a suitable end plate 50, fastened to an adaptor 51 which is in turn threadedly engaged at 52 to the end of the pull rod.

A spacer 53 is provided and positioned between the end plate 50 and the member 9 so that it will press there against and provide clutching action in a manner to be described shortly.

The other member 10 being a fixed plate unit, is fastened at 54 to the recoiler shaft, and is so firmly fixed as to facilitate the pressing of the respective plates through their clutch elements, into driving condition and support on the recoiler shaft 1.

It will be apparent that suitable operating of the actuator 41 will in turn exert tension on the pull rod 40 and compress the clutch discs 36 at opposite sides and against the opposite sides of the plate 7 and between the backup plate 10 and simultaneous rotation of the respective plates 7 may take place.

However in the event it is necessary for reasons which are obvious during the recoiling that a certain amount of slippage is necessary to take place, slippage of the core plate 7 rotatably with respect to one another is possible.

Turning now to a consideration of the actual operation of the mechanism, it will be noted that initially the core plates 7 are manipulated so that the cam members 25 seated therein, being actuated by the wrench 35 are positioned so that the peripheries conform to the dotted lines 30.

Thereafter such core plates as may be required, are positioned on the recoiler shaft 1, and between the spacers such as 8, with the clutch discs 36 being availed of of course and these being of any desired thickness provide for the width of stock to be recoiled on the peripheries of the plates 7.

The actuator 41 is thereupon actuated, compressing the clutch elements and discs and the plates therebetween so that the plates are driven rotatively, and thereafter the stock ends inserted in the slits 24, to provide for coiling of the stock around the peripheries of the respective plates 7.

Recoiling thereafter takes place, and slippage where necessary being possible to accommodate for varying conditions during the slitting operation.

When the slitting operation is completed and the material coiled on the respective plates, the end plate unit 50 is removed and the various core plates 7 likewise removed from the recoiler shaft 1.

Thereafter by manipulation of the wrench 35, inserted in the square opening in each of the core plates 7, the cam member 25 thereof is rotated into the position where the flat thereon conforms or is in line with the flat in the core plate central member, thereby collapsing the core plates by moving the periphery back into the solid line position 30*a*.

Subsequently of course the core plate 7 may be removed from its position within the coiled stock, and immediately thereafter the wrench 35 manipulated so as to cause the cam member to be rotated into the position shown in FIG. 5 at the left hand portion thereof, thereby expanding the periphery into the position of the dotted line designated 30 for subsequent repositioning on the recoiler shaft 1 and again coiling of stock thereabout.

It will thus be understood that a relatively simple in fact rather inexpensive construction is provided which is very effective to provide for recoiling of stock, and by suitable manipulation to make the coiling on and removal of such stock as coiled from the core plate a relatively simple operation.

The central drive by the clutch discs, and spacing provided thereby, with the flats of the clutch discs 36*a* and 36*b* obviously being driven by the recoiler shaft 1 and flats 36*c* thereon, under the compressive effect of the actuator 41 make the operation, easily effected.

I claim:

1. Recoiler mechanism including a core plate of relatively thin material having a main body and complementary arcuate portions of like thinness providing a part of the peripheral surface of the core plate, said portions being integrally connected with the body, forming with the body, a flexible surface about which material may be coiled, the arcuate portions terminating in adjacent free ends, and means intermediate the free ends, to effect expandible and subsequent collapsible movement of at least part of the portions to enable removal of material coiled about the surface.

2. Mechanism as claimed in claim 1, wherein main body and complementary arcuate portions are formed in a central plate member, a cam member is provided for effecting expanding and collapsing movement of said portions, a similar plate member is positioned at each side of the central plate member and secured thereto, the cam member being supported by the side plates for rotation to effect the movement aforesaid, and means to effect rotation of said core plate.

3. Mechanism as claimed in claim 2, wherein the central plate member is provided with a cam member opening near its periphery, the expandible peripheral portions are adjacent generally arcuate slots extending oppositely therefrom a substantial distance around the member near the peripheral edge thereof, the side plates having openings axially aligned with the cam member opening aforesaid, and the cam member is journaled in said openings, whereby rotation of said cam member will actuate the expandible portions aforesaid.

4. Mechanism as claimed in claim 3, wherein means are provided to operate said cam member to expand and contract the said expandible portions.

5. Mechanism as claimed in claim 2, wherein a recoiler shaft is supported for rotation, a series of core plates is mounted on said shaft, clutch means drivably connect the shaft and plates, and means to effect clutching action of said clutch means, whilst permitting limited relative slippage of the said plates.

6. Mechanism as claimed in claim 5, wherein the clutch means comprise clutch discs drivably mounted on the shaft and intermediate the said discs, clutch facing material is fixed to said plates for engagement by the discs, and the means to effect clutching action are arranged to press the discs and plates together along the shaft.

7. Mechanism as claimed in claim 5, wherein the recoiler shaft is provided with operating means extending to an actuator, the actuator being operable to vary the clutching action of the clutch means.

8. Mechanism as claimed in claim 5, wherein the recoiler shaft is provided with operating means extending to an actuator, the actuator being operable to vary the clutching action of the clutch means, the recoiler shaft is hollow and the operating means comprise a pull rod extending therethrough, said pull rod being connected to an end plate which in turn effects compression action on the core plates and clutch discs, between said end plate and a back plate supported on said shaft, and the actuator comprises a bellows unit connected to the other end of the pull rod and operable by air admitted thereto under control to cause the clutching action aforesaid.

* * * * *